US007836746B2

(12) United States Patent
Ericson

(10) Patent No.: US 7,836,746 B2
(45) Date of Patent: Nov. 23, 2010

(54) DEVICE AND A METHOD FOR HOLDING TOGETHER TOOL PARTS DRUING A HYDROFORMING PROCESS

(75) Inventor: Jan Ericson, Stora Skedvi (SE)

(73) Assignee: Hydroforming Design Light AB, Vansbro (SE)

( * ) Notice: Subject to any disclaimer, the term of this patent is extended or adjusted under 35 U.S.C. 154(b) by 333 days.

(21) Appl. No.: 11/996,387

(22) PCT Filed: Jun. 30, 2006

(86) PCT No.: PCT/SE2006/050236

§ 371 (c)(1),
(2), (4) Date: Feb. 25, 2008

(87) PCT Pub. No.: WO2007/015671

PCT Pub. Date: Feb. 8, 2007

(65) Prior Publication Data

US 2008/0236239 A1 Oct. 2, 2008

(30) Foreign Application Priority Data

Aug. 4, 2005 (SE) ..... 0501780

(51) Int. Cl.
*B21J 9/18* (2006.01)
*B21D 26/02* (2006.01)
*B30B 1/16* (2006.01)

(52) U.S. Cl. ..... 72/450; 72/61; 72/455; 100/271; 100/283; 100/285; 29/421.1; 83/605; 83/611

(58) Field of Classification Search ..... 72/61, 72/453.03, 450, 455, 456; 100/231, 272, 100/281, 283, 285; 29/421.1; 83/605, 611
See application file for complete search history.

(56) References Cited

U.S. PATENT DOCUMENTS

| | | | | | |
|---|---|---|---|---|---|
| 2,461,034 | A | * | 2/1949 | Castle | 72/453.03 |
| 2,890,649 | A | * | 6/1959 | Hodges | 100/231 |
| 3,253,440 | A | * | 5/1966 | Baker | 72/453.19 |
| 3,472,057 | A | * | 10/1969 | Steele | 72/396 |
| 3,482,429 | A | * | 12/1969 | Lombard | 72/450 |
| 3,552,183 | A | * | 1/1971 | Heitmann | 72/450 |
| 3,577,882 | A | * | 5/1971 | Lombard | 72/450 |
| 4,329,865 | A | * | 5/1982 | Meinholdt | 72/450 |

(Continued)

FOREIGN PATENT DOCUMENTS

FI 179660 B 10/1989

(Continued)

*Primary Examiner*—David B Jones
(74) *Attorney, Agent, or Firm*—Michaud-Kinney Group LLP

(57) ABSTRACT

The present invention relates to a device and a method for holding tool parts together during a hydroforming process. The device comprises a first portion comprising a first force transmitting surface and a second portion comprising a second force transmitting surface, which are connected by means of a pivot, and a length variable power member which, with a force, tends to turn the second portion in relation to the first portion around the pivot by means of a first lever which is longer than a second lever by means of which a resultant larger force is created which acts between said force transmitting surfaces for holding the tool parts together during a hydroforming process.

12 Claims, 3 Drawing Sheets

U.S. PATENT DOCUMENTS 5,060,566 A * 10/1991 Ihara ..... 72/450
5,477,725 A 12/1995 Muller
5,600,983 A * 2/1997 Rigsby ..... 72/61
5,709,144 A 1/1998 Shiokawa et al.
5,927,120 A * 7/1999 Marando ..... 72/61
6,298,701 B1 * 10/2001 Marando ..... 72/61
7,047,780 B2 * 5/2006 Marando et al. ..... 72/61

FOREIGN PATENT DOCUMENTS

WO WO 00/27563 5/2000
WO WO 01/36123 A1 5/2001

* cited by examiner

DEVICE AND A METHOD FOR HOLDING TOGETHER TOOL PARTS DRUING A HYDROFORMING PROCESS

FIELD OF THE INVENTION

The present invention relates to a device and a method for holding tool parts together during a hydroforming process. The device comprises a first portion having a first force transmitting surface, a second portion having a second force transmitting surface, which force transmitting surfaces are arranged to hold the tool parts together during a hydroforming process, and a length variable power member.

BACKGROUND OF THE INVENTION

Hydroforming is a process, which principally is used for manufacturing components of metal which many times have a complicated geometrical shape. A conventional tool for hydroforming consists of two tool halves which are movably arranged in relation to each other between an open state and a closed state. At least one of the tool halves is provided with a recess in which it is possible to apply a blank to be worked. In the closed state of the tool halves, the recess is closed and the blank is formed by the surfaces of the recess by means the introducing of a liquid under high pressure.

When a liquid with such a high pressure is accumulated in the closed recess, large forces are required to hold the tool halves together. Usually, very large presses are used for generating the necessary forces. Such presses also require auxiliary equipment, such as, among other things, a foundation for sustaining the large forces generated by the presses. Therefore, very large capital investments are required in order to have and/or use such presses for holding the tool halves together during a hydroforming process.

WO 01/36123 shows a hydroforming device for holding the tool halves together during a hydroforming process. The hydroforming device comprises an aggregate with clamps having wedge-shaped recesses by which they press the tool halves together from opposite sides during the hydroforming process. By means of such clamps the required forces are provided for holding the tool halves together during a hydroforming process in a relatively simple manner and without the need for using large presses. The clamps are arranged at equal distances along substantially the whole long sides of the tool halves. Thereby the accessible space is restricted for, for example, a robot which applies blanks in the tool and picks out formed details.

SUMMARY OF THE INVENTION

The object of the present invention is to provide a device for holding tool parts together during a hydroforming process, which device has significantly smaller dimensions and fewer components than conventional press devices for hydroforming such that it can be manufactured to a significantly lower cost.

This object is achieved with a hydroforming device wherein a second portion is connected to the first portion by means of a pivot. A power member has a connection with the second portion and a connection with the first portion such that when the power member supplies a force, the power member tends to turn the second portion in relation to the first portion around the pivot by means of a first lever which is longer than a second lever by means of which a resultant larger force is created acting between said force transmitting surfaces for holding the tool parts together during a hydroforming process. Consequently, the second portion here is used as a lever, which is turned around a pivot in relation to the first portion. The pivot is positioned in a place in relation to the second portion such that a desired ratio between the first lever and the second lever is obtained. Thus, a corresponding force ratio between the supplied force and the resultant force is obtained. The resultant force, which holds the tool parts together during a hydroforming process, may be many times larger than the supplied force. Thus, the device does not need to comprise large hydraulic cylinders and the need of other auxiliary equipment is also considerably reduced. The included components of the device can thus be given small dimensions. The supplied force as well as the resultant force tend to turn the portions of the device in relation to each other. Thus, either the supplied force or the resultant force are transmitted to the ground on which the device stands. Thus, the device may be placed at a substantially arbitrary place on an ordinary factory floor. Consequently, the device does not need to be provided with a foundation, which absorbs these forces. The cost for the device thus will be essentially lower than the cost for a conventional press device.

According to a preferred embodiment of present invention, the second portion comprises an elongated element connected to the first portion via said pivot. If the second portion is to be used as lever, it is suitable that it has a relatively elongated shape for making a relatively large power exchanging possible. However, the elongated element has to have a sufficient rigidity for transmitting the large forces which here are present. The elongated element may be connected to an extension element comprising the force transmitting surface of the second portion. In order to permit the force transmitting surface of the second portion be able to get into a position such that it can transmit the resultant force against one of the tool halves, it could be necessary to provide the elongated element with such an extension element. Alternatively, the elongated element may comprise the force transmitting surface of the second portion. The elongated element may here be given a suitable shape such that it can transmit the resultant force directly from its force transmitting surface against a tool half.

According to another preferred embodiment of present invention, the first portion comprises a table having a surface arranged to form the force transmitting surface of the first portion. Such a table may be a substantially horizontal surface on which the tool parts are directly or indirectly arranged. Advantageously, the surface of the table has a size such that the tool parts can be displaced along the surface of the table between an outer position on the surface of the table, in which the tool parts are adjustable to an open state, and an inner position on the surface of the table, in which the hydroforming process is performed. Since a lever effect is used, the force transmitting surfaces, which transmit the larger resultant force, provide a relatively small motion. It is simple to displace the tool parts to the outer position with the present invention as soon as the force transmitting surfaces have released their grip of the tool parts. In the outer position, there is space for adjusting the tool parts to an open state. There is usually a free space at the outer side of the table. Consequently, when the tool parts are in the outer position on the table, there is a lot of place to pick out a manufactured detail and to apply a new blanket in the tool. These steps may be performed by means of a robot.

According to another preferred embodiment of present invention, the first portion is stationarily arranged on a ground. The device thus has a restricted number of moveable parts. The stationary portion may comprise a support portion having a solid body with an extension between the force transmitting surface and the ground on which the stationary portion is placed. The force transmitting surface thus rest on a solid body such that it can hold the tool parts together with a large force. Advantageously the stationary portion comprises an upwardly projecting part comprising the pivot by which the second portion is connected to the stationary portion. By means of such a pivot, a substantially elongated element may be given a substantially horizontal extension at a level largely located above the stationary portion. A length variable power member having en substantially vertical extension may here use such a horizontal element as lever in an optimal manner. The stationary portion may comprise a rearwardly projecting part comprising a connection to the power member. The rear part may extent rearwardly the same distance as a rear part of the elongated element. Thereby, a power member may be given a vertical attachment at a relatively long distance from the pivot.

Alternatively, both the first portion and the second portion may be moveably arranged. In this case, both the first portion and the second portion provide a motion when they transmit the supplied force of the power member to a larger resultant force holding the tool parts together during a hydroforming process. The first portion may comprise an elongated element crosswise connected to the elongated portion of the second portion by means of said pivot. In this case, the device comprises a scissors-like construction with two levers. The elongated element of the first portion may here comprise the force transmitting surface of the first portion. The first elongated element is given a shape such that it can transmit the resultant force directly to a tool half via its force transmitting surface.

According to another preferred embodiment of present invention, the first portion and/or the second portion are at least partly constructed by lamellae. By connecting together a suitable numbers of such lamella with the same size and shape, the parts of the first portion and the second portions may be given a variable width. Advantageously, the lamellae are constructed in a metal material with good strength properties.

The above mentioned object is also achieved by the method which comprises the steps of connecting a first portion comprising a first force transmitting surface with a second portion comprising a second force transmitting surface by means of a pivot, connecting a length variable power member with the first portion by means of a connection and the second portion by means of a connection and activating the power member such that it supplies a force which tends to turn the second portion in relation to the first portion around the pivot by means of a first lever which is longer than a second lever by means of which a resultant larger force is created which acts between said force transmitting surfaces for holding the tool parts together during a hydroforming process. The method means that the second portion is used as a lever, which transmits a supplied force to a larger resultant force. Thereby, it is possible to create a sufficiently large force in a relatively simple manner for holding the tool parts together during a hydroforming process by use of a comparatively small power member.

SHORT DESCRIPTION OF THE DRAWINGS

In the following, preferred embodiments of the invention is described as examples with reference to the attached drawings, on which:

DETAILED DESCRIPTION OF EMBODIMENTS OF THE INVENTION

Figure 1:
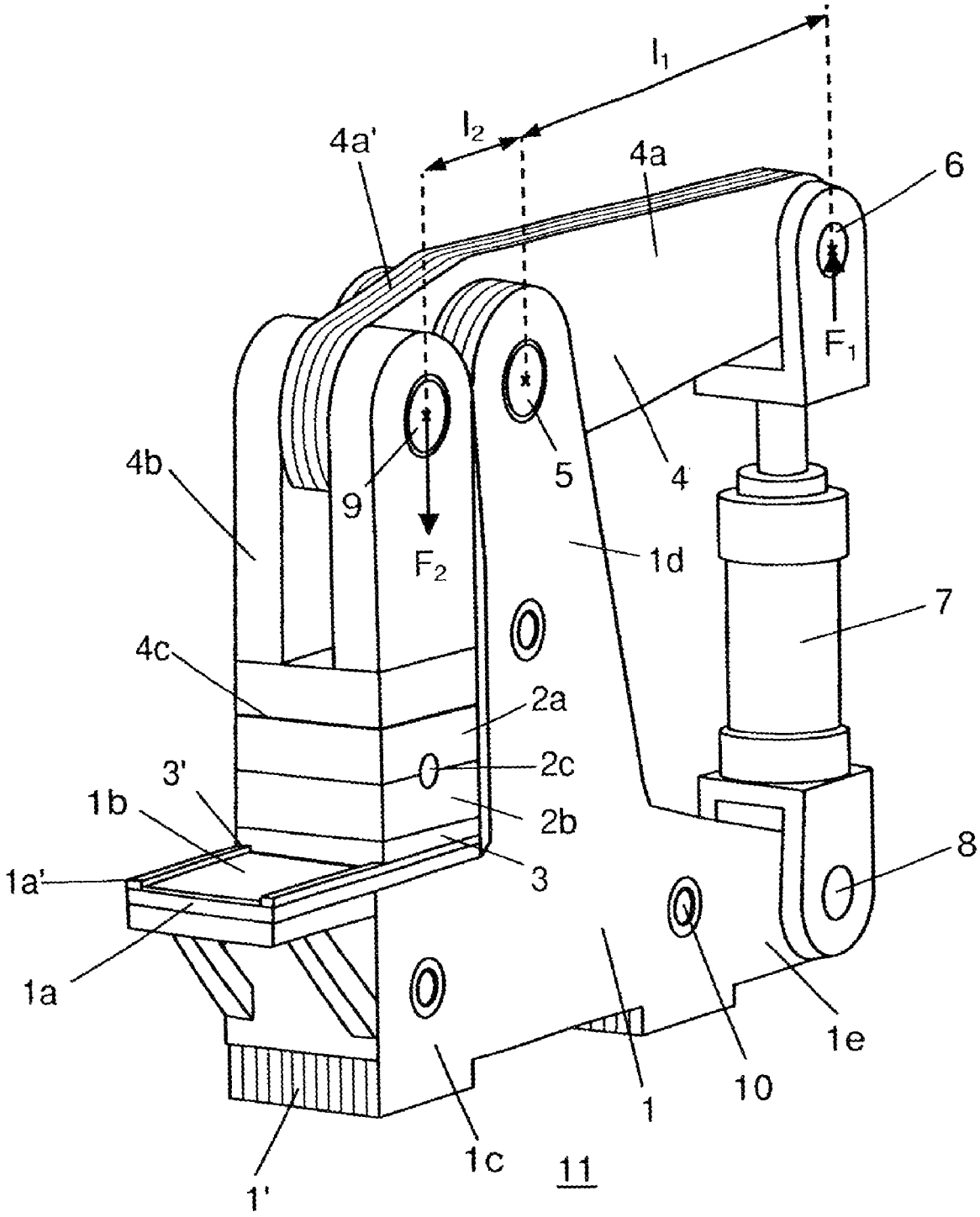
FIG. 1 shows a first embodiment of a device according to the invention.

FIG. 1 shows a machine for hydroforming. The machine consists of a stationary first portion 1 comprising a table 1*a* for carrying a hydroforming tool consisting of an upper tool half 2*a* and a lower tool half 2*b*. The tool halves 2*a, b* are movably arranged in relation to each other between a closed state and an open state. The tool halves 2*a, b* are shown in the closed state in FIG. 1. The tool halves 2*a, b* are attached to a plate 3 having recesses $\mathbf{3}^1$ arranged on the sides, which recesses are adapted to cooperate with correspondingly shaped tracks 1*a*' of the table. The tool halves 2*a, b* are thus displaceably provided along the surface of the table 1*b* as a unit between an inner position and an outer position. The first portion 1 comprises a support portion 1*c* which forms an underlying solid support for the surface of the table 1*b*. The first portion 1 also comprises an upwardly projecting part 1*d* and a rearwardly projecting part 1*e*.

The machine consists of a second movable portion 4. The second portion 4 comprises an elongated element in the form of an arm 4*a* which, via a pivot 5, is turnably connected to an end of the upwardly projecting part 1*d* of the first portion 1. One end of the arm 4*a* is, via a pivot 6, connected to an end of a hydraulic cylinder 7. An opposite end of the hydraulic cylinder is, via a pivot 8, connected to an end of the rearwardly projecting part 1*e* of the first portion. The pivot 6 of the arm 4*a* is provided substantially vertically above the pivot 8 of the rearwardly projecting part 1*d*. Thereby, the hydraulic cylinder 7 has a substantially vertical extension. An opposite end of the arm 4*a* is, via a pivot 9, connected to an extension element 4*b*. The extension element 4*b* has a downwards turned force transmitting surface 4*c* which is intended to be in contact with a surface of the upper tool half 2*a* during a hydroforming process. The first portion 1 and the arm 4*a* of the second portion 4 are constructed of plate lamellae 1', 4'. By bringing together a suitable number of such plate lamellae 1', 4' with the same size and shape, the first portion 1 and the arm 4*a* of the second portion may be given a desired broad. The lamellae 1', 4' are held together by means of fastening members 10. The first portion 1 is stationary arranged on a ground 11.

When a hydroforming process is to be started, the tool is placed in an outer position on the surface 1*b* of table with the tool halves 2*a, b* in an open state. At least the lower tool half 2*b* is provided with a recess in which a blank is applied to be hydroformed to a detail. Thereafter, the tool halves 2*a, b* are brought together to a closed state whereupon they with aid of the recesses 3' of the plate and the tracks 1*a*' of the table are displaced to an inner position on the surface 1*b* of the table. Thereafter, the hydraulic cylinder 7 is activated such that it provides a prolongation. The hydraulic cylinder 7 thus supplies a substantially vertically directed force $F_1$. The hydraulic cylinder 7 thereby turns the arm 4*a* around the pivot 5 in an anticlockwise direction such that the force transmitting surface 4*c* of the extension element 4*b* comes in contact with the upper tool half 2*a*. The hydraulic cylinder 7 turns the arm 4*a* with a torque, which is the product of the supplied force $F_1$ of the hydraulic cylinder and the length $I_1$ of a first lever. Since the arm 4*a* has a substantially horizontal extension, the vertical force $F_1$ is substantially applied in a direction perpendicular in relation to the extension of the arm 4*a*. Thus, the length $I_1$ of the first lever is substantially the distance between the pivots 5, 6. On the other side of the pivot 5, an equally large torque is provided which is the product of the length $I_2$ of a second lever and a resultant substantially vertically downwards directed force $F_2$, which the force transmitting surface 4*c* exerts to the upper tool half 2*a*. Since also the force $F_2$ substantially is applied perpendicularly in relation to the extension of the lever 4*a*, the length $I_2$ of the second lever is substantially the distance between the pivots 5, 9. When the length of the first lever $I_1$ is several times longer than the length $I_2$ of the second lever, the resultant force $F_2$ will be a corresponding number of times larger than the supplied force $F_1$. Since the surface of the table 1*b* consists a solid underlying support surface for the tool halves 2*a, b*, the tool halves 2*a, b* are held together between the force transmitting surface 1*b* of the table and the force transmitting surface 4*c* of the pressure element with the resultant force $F_2$ which thus is considerably larger than the supplied force $F_1$.

In the closed state of the tool halves 2*a, b*, a closed space is provided. The tool halves 2*a, b* comprise openings 2*c* to the closed space. Not shown end feed cylinders are applied in the openings 2*c* by means of which a liquid with a very high pressure is conducted into the space. The pressure of the liquid is of a size such that it permits the blank to flow and be formed by the walls of the space to a detail with a desired shape. Usually, the process takes some tenth of a second. The pressure in the closed space, during a high pressure forming process may be of the magnitude of 700 Mpa. Consequently, a very large force for holding the tool halves 2*a, b* together during such a process is required.

With the above-described machine, an arm 4*a* is used which works as a lever for providing a considerably larger resultant force $F_2$, which holds the tool halves 2*a, b* together, than the supplied force $F_1$. Consequently, a required high uniting force can be provided in a relatively simple manner. No large hydraulic cylinders need to be used and the need for other auxiliary equipment is also considerably reduced. Since the resultant force $F_2$ and the supplied force $F_1$ act between the moveably connected portions 1, 4 of the machine, substantially no one of these forces $F_1$ $F_2$ loads the ground 11, which supports the machine. Consequently, the machine can be placed on a substantially arbitrary place on an ordinary factory floor. Consequently, there exists no need of a foundation, which is the case when conventional presses are used in this connection. The cost for the machine according to the invention will thus be considerably cheaper than the cost for the presses which conventionally are used for holding the tool halves together during a hydroforming process.

After that a hydroforming process has been finished, the hydraulic cylinder 7 is activated such that it turns the arm 4*a* around the pivot 5 in a clockwise direction such that the force transmitting surface 4*c* of the extension element 4*b* is raised a bit from the upper tool half 2*a*. Consequently, the tool 2*a, b* is free such that it can be displaced to an outer position on surface of the table 1*b*. In this outer position, the tool halves 2*a, b* are adjusted to an open state such that the formed detail can be picked out. Thereafter, a new blanket is applied in the recess of the lower tool half 2*b*. When the tool halves 2*a, b* are in the open state on the outer part of the surface 1*b* of the table, a very good accessibility is provided to apply blankets in the tool and to pick out ready details. The above-described hydroforming process may be performed substantially continuously and by means of a robot. With the above-described machine, a production cycle may be provided which hydroforms details with a very high speed.

Figure 2:
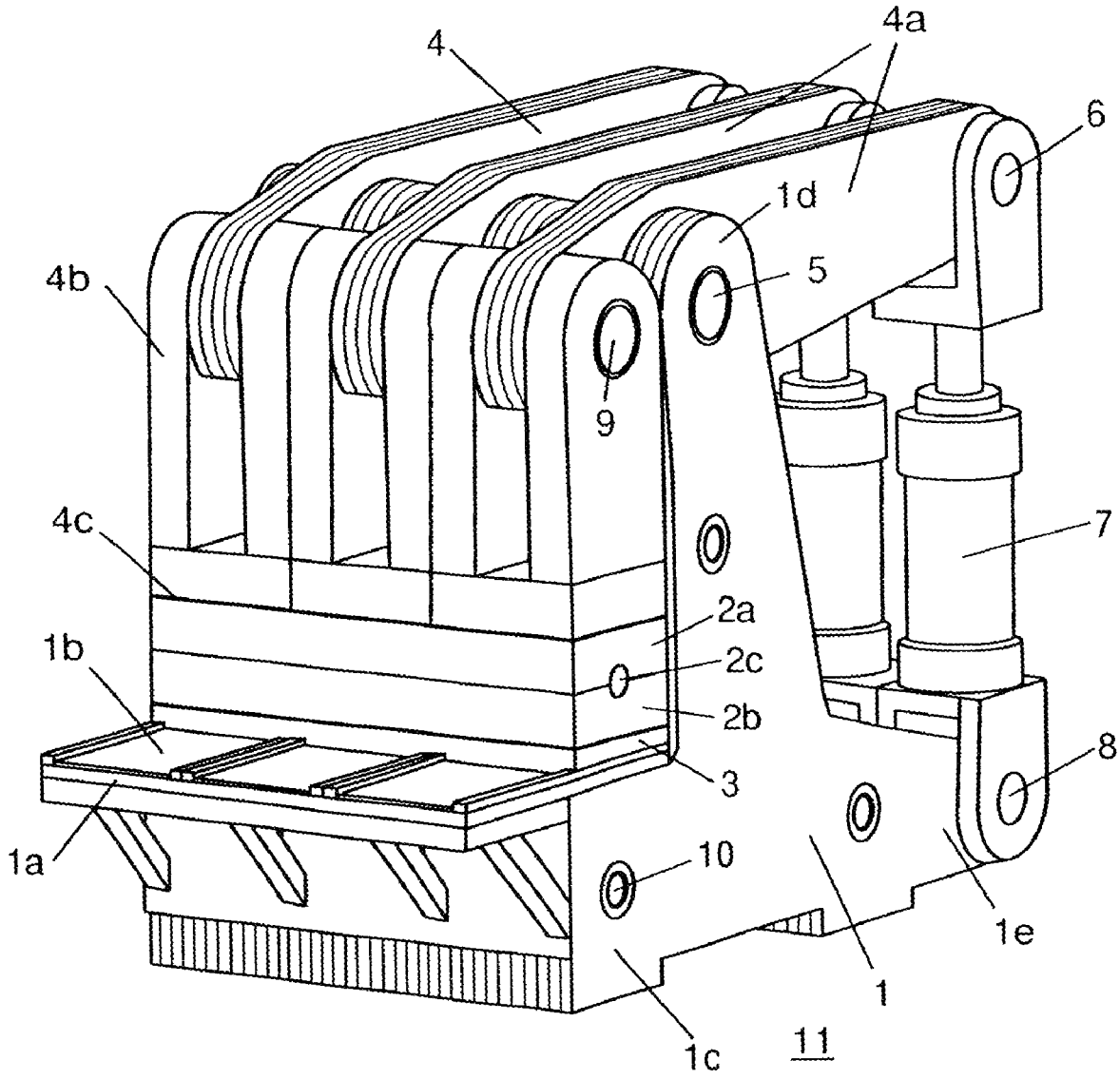
FIG. 2 shows a second embodiment of a device according to the invention.

The machine shown in FIG. 1 is constructed as a module. FIG. 2 shows three such modules connected together to a larger machine. The modules have here been connected together in a row after each other such that a connected table 1*a* is provided having a relatively broad surface 1*b*. At the same time, the pressure parts 4*b* form a correspondingly elongated connected pressure surface 4*c*. In such a machine, a tool 2*a, b* can be applied, which is intended for forming of elongated details.

Figure 3:
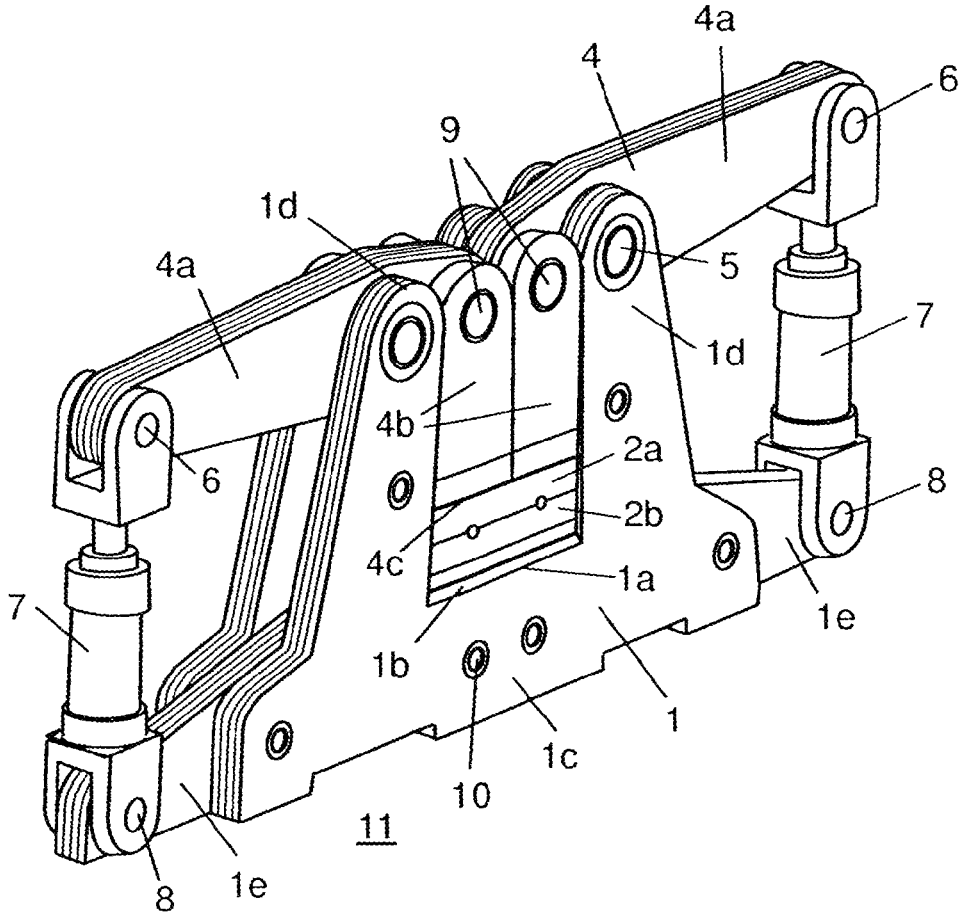
FIG. 3 shows a third embodiment of a device according to the invention.

FIG. 3 shows a further variant where two modules are connected together such that they form a larger machine. The modules have here been connected together against each other such that a table 1*a* is formed which can support relatively broad tool halves 2*a, b*. At the same time, the pressure parts 4*b* form a pressure surface 4*c* of a correspondingly size. In such a machine, a tool 2*a, b* can be applied, which is intended for hydroforming of broad details.

Figure 4:
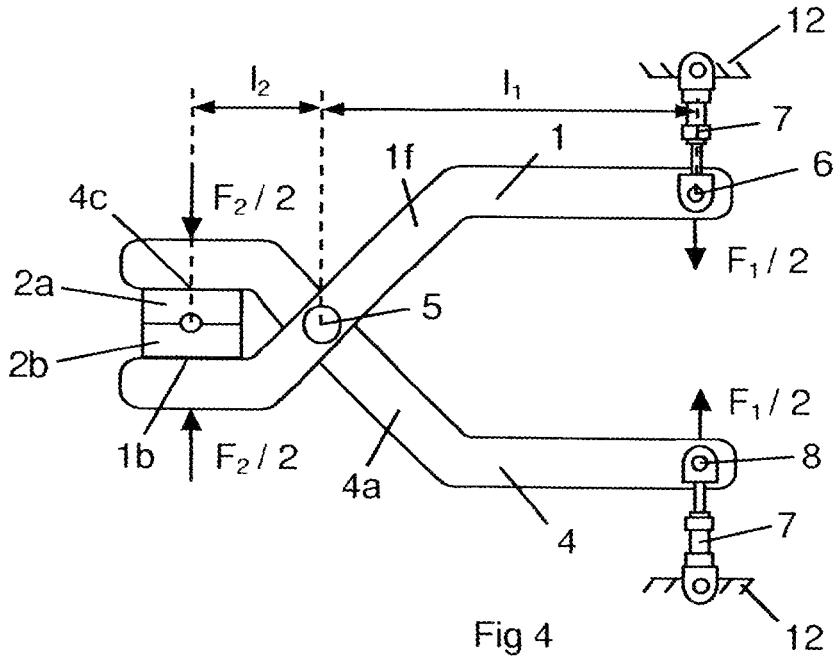
FIG. 4 shows a fourth embodiment of a device according to the invention.

FIG. 4 shows a machine with a first portion 1 in the form of an elongated arm 1*a* and a second portion 4 in the form of a correspondingly shaped elongated arm 4*a*. The first arm 1*f* and the second arm 4*a* are crosswise connected with each other via a pivot 5. A first hydraulic cylinder 7 is applied such that it can supply a force F-ι/2 between a stationary part 12 and a pivot 6 of an end of the first arm 1*a*. A second hydraulic cylinder 7 is applied such that it can supply a force F^2 between a stationary part 12 and a pivot 8 of an end of the second arm 4*a*. Advantageously, the stationary parts 12 are comprised in a common frame construction which can support the forces from the hydraulic cylinders 7 such that they do not load the surrounding floor, roof etc. The two hydraulic cylinders 7 are capable to press said ends of the first arm 1*a* and the second arm 4*a* together with a total force $F_1$. The hydraulic cylinders 7 supply a total torque to the arms 1*f*, 4*a* which is the product of the first force $F_1$ and a first lever $I_1$. On the other side of the pivot 5, the first arm 1 has en force transmitting surface 1*b* which is intended to come in contact with a surface of an upper tool half 2*a*. On the other side of the pivot 5, the second arm 4 has a force transmitting surface 4*c* which is intended to come in contact with a surface of a lower tool half 2*b*. The total torque of the arms on the other side of the pivot 5 is equal with the torque on the first side of the pivot 5. Since the second lever the $I_2$ here has been made considerably shorter for the arms 1*f*, 4*a* than the first lever $I_1$, the total resultant the force $F_2$, which holds the tool halves 2*a, b* together, will be considerably larger than the supplied force $F_1$.

The present invention is not limited to the embodiments described on the drawings, but may be modified freely within the scope of the claims. The power member does not need to be a hydraulic cylinder but may be a substantially arbitrary force member which is variable in length. The device is not limited to hold only two tool halves together but it can be used to hold more than two tool parts together during a hydroforming process.

What is claimed is:

1. A device for holding tool parts together during a hydroforming process, comprising:

a first portion having a first force transmitting surface;

a second portion having a second force transmitting surface, which force transmitting surfaces are arranged to hold the tool parts together during a hydroforming process; and a length variable power member;

the second portion being connected to the first portion via a pivot, and wherein the power member has a connection with the second portion and a connection with the first portion such that when the power member supplies a force the power member turns the second portion in relation to the first portion around the pivot via a first lever, wherein the first lever is longer than a second lever located on an opposite side of the pivot in relation to the first lever, wherein a resultant larger force is created which acts between said force transmitting surfaces for holding the tool parts together during a hydroforming process, wherein the first portion comprises a table having a surface comprising the force transmitting surface of the first portion, and wherein the surface of the table has a size such that the tool parts can be displaced along the surface of the table between an outer position on the surface of the table in which the tool parts are adjustable to an open state and an inner position on the surface of the table in which the hydroforming process is performed.

2. A device according to claim 1, wherein the second portion comprises an elongated element connected to the first portion via said pivot.

3. A device according to claim 1, wherein the elongated element is connected to an extension element comprising the force transmitting surface of the second portion.

4. A device according to claim 1, wherein the first portion is stationarily arranged on a ground.

5. A device according to claim 4, wherein the stationary first portion comprises a support portion having a solid body with an extension between the force transmitting surface and said ground.

6. A device according to claim 4, wherein the stationary portion comprises an upwards projecting part comprising the pivot by which the second portion is connected to the stationary portion.

7. A device according to claim 4, wherein the stationary portion comprises a rearwardly projecting part, which comprises a connection with the power member.

8. A device according to claim 4, wherein the first portion and the second portion are movably arranged.

9. A device according to claim 2, wherein the first portion comprises an elongated element which is crosswise connected with the elongated portion of the second portion by means of said pivot.

10. A device according to claim 9, wherein the elongated element of the first portion comprises the force transmitting surface of the first portion.

11. A device according to claim 1, wherein the first portion and/or the second portion are at least partly constructed by lamellae.

12. A method for holding tool parts together during a hydroforming process, the method comprising the steps of:

connecting a first portion comprising a first force transmitting surface with a second portion comprising a second force transmitting surface by means of a pivot;

connecting a length variable power member with the first portion by means of a connection and the second portion by means of a connection; and activating the power member to supply a force which turns the second portion in relation to the first portion around the pivot by means of a first lever, where the first lever is longer than a second lever on an opposite side of the pivot in relation to the first lever, wherein a resultant larger force is created which acts between said force transmitting surfaces for holding the tool parts together during a hydroforming process, wherein the first portion comprises a table having a surface comprising the force transmitting surface of the first, and wherein the surface of the table has a size such that the tool parts can be displaced along the surface of the table between an outer position on the surface of the table in which the tool parts are adjustable to an open state and an inner position on the surface of the table in which the hydroforming process is performed.

* * * * *